US009323220B2

(12) United States Patent
Tu

(10) Patent No.: US 9,323,220 B2
(45) Date of Patent: Apr. 26, 2016

(54) LEVER ESCAPEMENT FOR A TIMEPIECE

(71) Applicant: Detra SA, Préverenges (CH)

(72) Inventor: Xuan Mai Tu, Ecublens (CH)

(73) Assignee: DETRA SA, Preverenges (CH)

( * ) Notice: Subject to any disclaimer, the term of this patent is extended or adjusted under 35 U.S.C. 154(b) by 0 days.

(21) Appl. No.: 14/443,827

(22) PCT Filed: Nov. 14, 2013

(86) PCT No.: PCT/EP2013/073807
§ 371 (c)(1),
(2) Date: May 19, 2015

(87) PCT Pub. No.: WO2014/079765
PCT Pub. Date: May 30, 2014

(65) Prior Publication Data

US 2015/0301501 A1 Oct. 22, 2015

(30) Foreign Application Priority Data

Nov. 26, 2012 (CH) ..... 2536/12

(51) Int. Cl.
*G04B 15/00* (2006.01)
*G04B 15/08* (2006.01)
*G04B 15/10* (2006.01)
*G04B 15/14* (2006.01)

(52) U.S. Cl.
CPC ..... *G04B 15/08* (2013.01); *G04B 15/10* (2013.01); *G04B 15/14* (2013.01)

(58) Field of Classification Search
CPC ..... G04B 15/08; G04B 15/10; G04B 15/14
USPC ..... 368/131–133
See application file for complete search history.

(56) References Cited

U.S. PATENT DOCUMENTS 3,146,581 A * 9/1964 Garbe ..... G04B 15/14 368/133
3,186,238 A * 6/1965 Archer ..... G04B 15/08 74/1.5
3,685,279 A * 8/1972 Scholz ..... G04B 15/12 368/128

(Continued)

FOREIGN PATENT DOCUMENTS

CH 101651 10/1923
CH 569997 11/1975

(Continued)

OTHER PUBLICATIONS

PCT/EP2013/073807 International Search Report dated Apr. 23, 2014 (6 pages including English translation).

(Continued)

*Primary Examiner* — Amy Cohen Johnson
*Assistant Examiner* — Daniel Wicklund
(74) *Attorney, Agent, or Firm* — Brinks Gilson & Lione; G. Peter Nichols

(57) ABSTRACT

The invention relates to a timepiece fitted with a lever escapement wherein the end of contact angles β1 and β2 between the pallet stones and the escapement wheel are respectively higher than the locking-angles δ2 and δ1 of the two locking positions of the lever. This escapement requires neither adjustment nor final alteration of the position of the pallet stones.

6 Claims, 14 Drawing Sheets

(56) References Cited

U.S. PATENT DOCUMENTS

| | | | | |
|---|---|---|---|---|
| 3,826,076 | A | 7/1974 | Tuetey | |
| 8,757,869 | B2 | 6/2014 | Kruttli | |
| 2009/0168611 | A1* | 7/2009 | Gigandet | G04B 17/06 368/130 |
| 2010/0208555 | A1* | 8/2010 | Hiraoka | G04B 15/14 368/131 |
| 2011/0149696 | A1* | 6/2011 | Cettour-Baron | G04B 15/08 368/131 |
| 2012/0120774 | A1* | 5/2012 | Fujieda | G04B 15/14 368/131 |
| 2012/0307601 | A1* | 12/2012 | Kruttli | G04B 15/08 368/129 |

FOREIGN PATENT DOCUMENTS

| | | |
|---|---|---|
| CH | 702930 | 10/2011 |
| DE | 2328074 | 2/1974 |
| GB | 682566 | 11/1952 |

OTHER PUBLICATIONS

PCT/EP2013/073807 Written Opinion dated Apr. 23, 2014 (5 pages).

* cited by examiner

LEVER ESCAPEMENT FOR A TIMEPIECE

This application claims priority to International Application No. PCT/EP2013/073807 filed Nov. 14, 2013 and to Swiss Application No. 02536/12 filed Nov. 26, 2012; the entire contents of each are incorporated herein by reference.

The present invention relates to a lever escapement for a timepiece, in particular for a wristwatch of spiral balance wheel type.

The lever escapement is a well known escapement type, it includes a lever having input and output pallet stones cooperating with an escapement wheel and a fork cooperating with the impulse-pin of the balance wheel.

The lever escapements generally have stationary elements for limiting the oscillation amplitude of the lever in the form of pins fixed to the plate. These limiting elements define the two lock positions of the lever. In these positions, the fork bears against the pins while a tooth of the escapement wheel bears against the locking-face of the input or output pallet stone of the lever.

There also exist lever escapements which include moveable elements for limiting the oscillation amplitude of the lever either by a particular shape of the escapement wheel, or by a particular shape of the pallet stones. These types of escapement are described in the documents GB 682 566, CH 101 651, CH 569 997, CH 702 930.

In the aforementioned documents, only the means for limiting the oscillation amplitude of the lever are proposed and not the means for bringing the lever to the optimum lock position based on the manufacturing tolerances.

In order to obtain a good operating of the escapement, the tooth bearing on the input or output pallet stones must be positioned very precisely with respect to the end of the locking-face of the pallet stones so that the release and impulse phases of the escapement unfold correctly. Considering the manufacturing tolerances, a lever escapement generally requires a final adjustment of the input and output pallet stone positions. This adjustment is generally long and tricky as it may strongly influence the performance of the escapement.

A purpose of the present invention is to propose a lever escapement which does not require an operation of adjusting the pallet stones based on the manufacturing tolerances.

Another purpose of the invention is to propose a mechanical timepiece equipped with such an escapement.

To this end, a first aspect of the invention is a lever escapement comprising:

- an escapement wheel
- a balance wheel
- a balance wheel axis around which the balance wheel can pivot,
- a lever with an input pallet stone, and an output pallet stone,
- a lever axis around which the lever can pivot in an angular oscillation movement,
- a reference axis (V) passing through the balance wheel axis and the lever axis characterized in that the escapement wheel, the input pallet stone and the output pallet stone are arranged so that an input end of contact angle $\beta 1$ of the lever with the reference axis (V) is higher than an output locking angle $\delta 2$ of the lever with the reference axis (V) and/or so that an output end of contact angle $\beta 2$ of the lever with the reference axis (V) is higher than an input locking angle $\delta 1$ of the lever with the reference axis (V).

The design of the escapement according to the present invention implies that the adjustments are highly reduced, as it is at the end of the impulse phase that the lever is found in the maximum angular position, and it returns back towards the middle position before being in locking position. This implies that it is not in abutment against outer pins such as a typical escapement, but that the locking position is a balanced position on the escapement wheel. This balanced position is ensured by the design of the shape of the pallet stones and/or the escapement wheel: no adjustment is required.

According to an embodiment, the ratio $\beta 1/\delta 2$ of the input end of contact angle $\beta 1$ and the output locking-angle $\delta 2$ is higher than 1.045 and/or in that the ratio $\beta 2/\delta 1$ of the output end of contact angle $\beta 2$ and the input locking-angle $\delta 1$ is higher than 1.045.

According to an embodiment, the escapement includes at least one driving plane, being either on one of the pallet stones of the lever, or on the escapement wheel and oriented so that the contact between the lever and the escapement wheel via said at least one driving plane creates a torque which tends to reduce the angle between the lever and the reference axis (V) connecting the axes of the lever and the balance wheel. In other words, the present implementation provides at least one driving plane which makes the lever arrive naturally in a balanced position, as the driving plane is arranged so as to create a torque creating a movement towards the balanced position.

According to one embodiment, driving angles $\gamma 1$ and/or $\gamma 2$ of the pallet stones or driving angles of the teeth of the escapement wheel range between 12 and 38 degrees. According to this implementation, the contact force exerted by the escapement wheel is outside the friction cone, hence the lever will slide to reach the locking position. It may be considered using for example a pair of steel/ruby materials to achieve this technical effect.

According to one embodiment, the escapement has limiting pins G1, G2 to limit a movement of the lever in case of shock.

A second aspect of the invention is a timepiece fitted with an escapement according to the first aspect.

The invention will be better understood upon reading the following description while referring to the accompanying drawings in which:

FIG. 1 represents a general plane view of a typical Swiss lever escapement. This escapement has:

Figure 1:
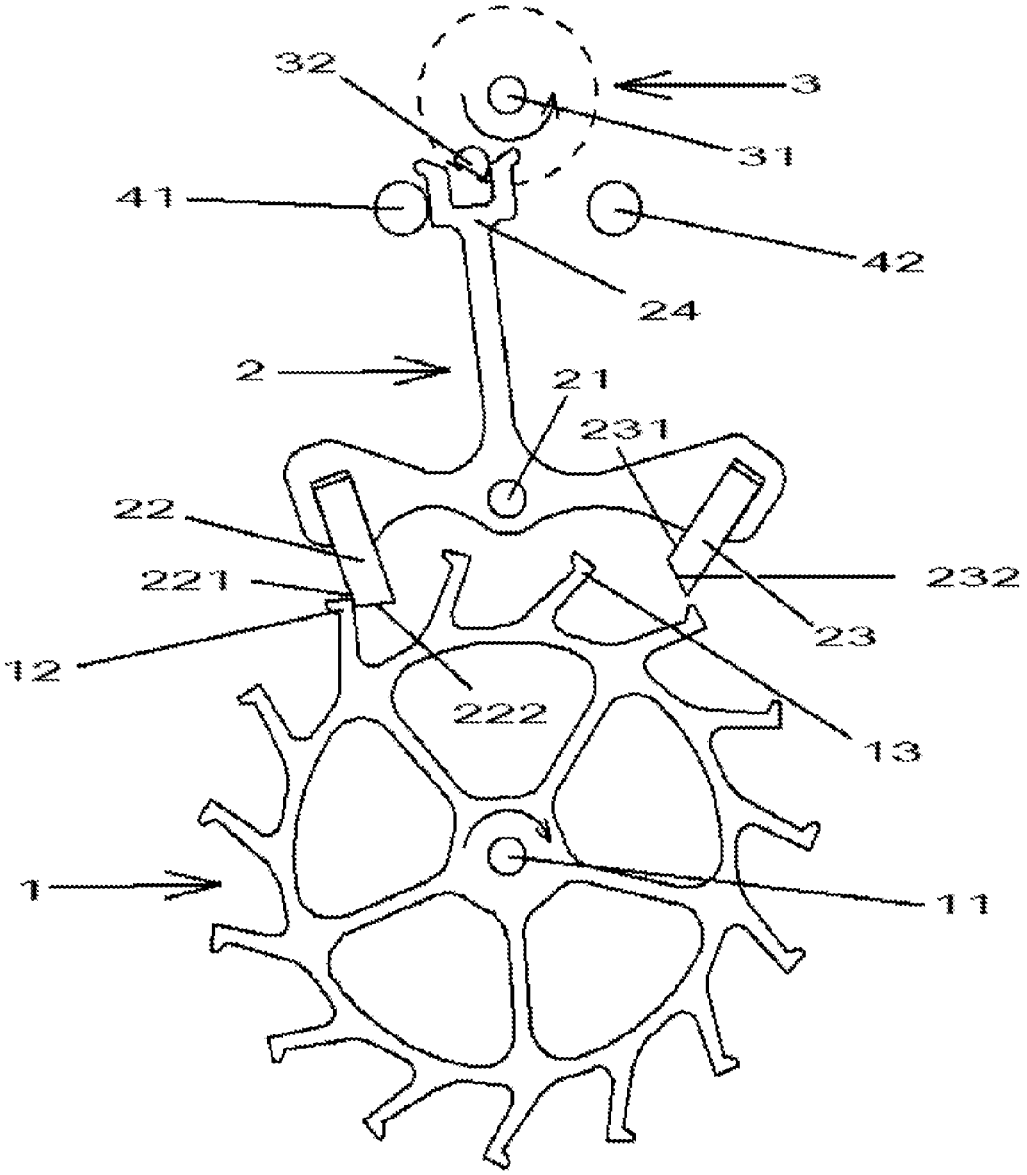
Fig. 1 (Prior Art)
FIG. 1 represents a general plane view of a typical Swiss lever escapement.

- an escapement wheel 1 rotating around the rotation axis 11 in the clockwise direction.
- a lever 2 rotating around the axis 21 and comprising an input pallet stone 22, an output pallet stone 23 and a fork 24
- a balance wheel plate 3 rotating around the axis 31 and carrying an impulse-pin 32 limiting pins 41 and 42.

In the represented embodiment, the lever 2 comprises a fork which temporarily engages during the oscillations with the pin 32, which causes an angular oscillation movement of the lever 2 around its lever axis 21. A straight line F which passes through the lever axis 21 and through the axis of symmetry of the fork 24 can therefore be defined. It is this straight line F which is used for measuring the angle of the lever 2 with the reference axis V. It is understood that if the fork is arranged on the balance wheel and the pin on the lever, the straight line F will therefore pass through the pin (of the lever), and through the lever axis 21.

The positions of the different elements of the escapement of FIG. 1 correspond to the input locking position of the lever. In this position, the tooth 12 of the escapement wheel bears on the locking-face 221 of the input pallet stone 22 and the fork 24 bears on the pin 41. When the impulse-pin of the plate 32 rotating in the counterclockwise direction comes in contact with the fork 24 in order to free the lever from its input locking position, the tooth 12 of the escapement wheel slides on the impulse plane 222 of the input pallet stone.

Figure 2:
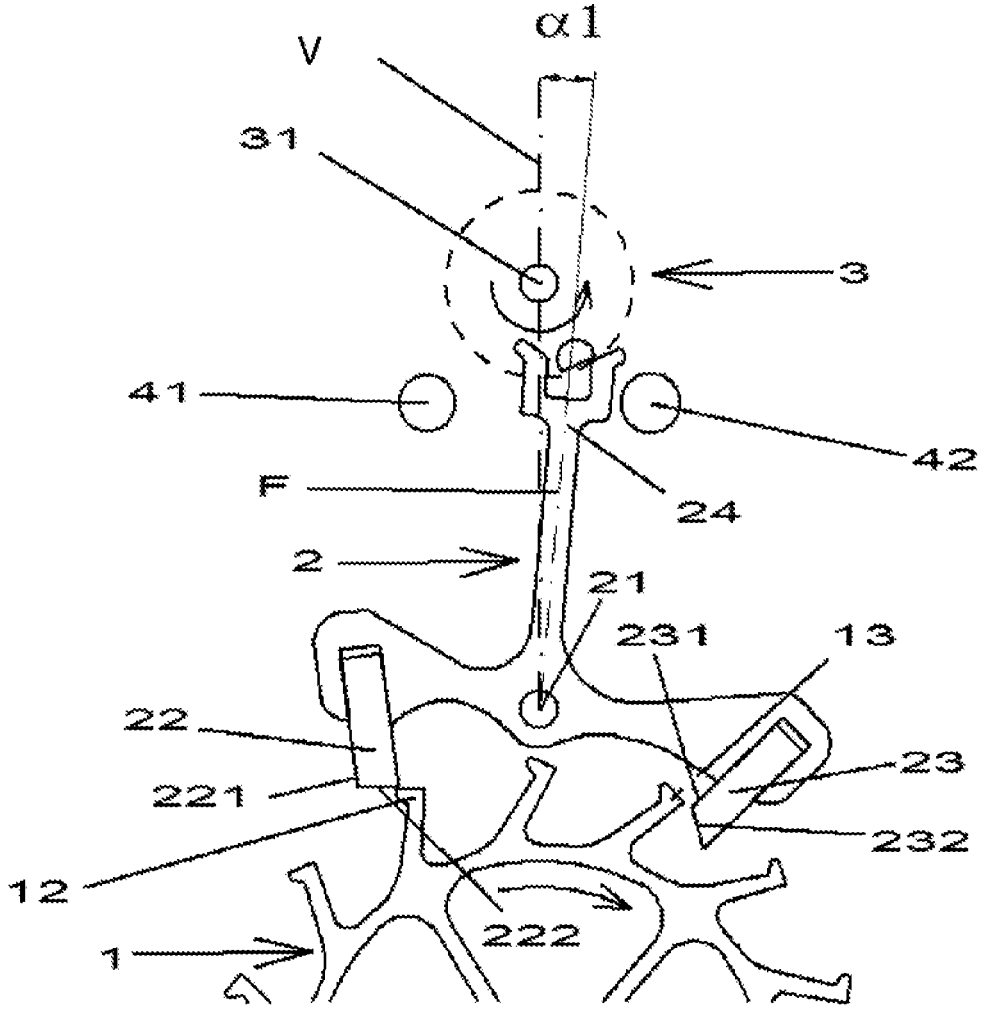
Fig. 2 (Prior Art)
FIG. 2 represents the end of contact between the input pallet stone and the tooth of the escapement wheel of a typical Swiss lever escapement.
Figure 3:
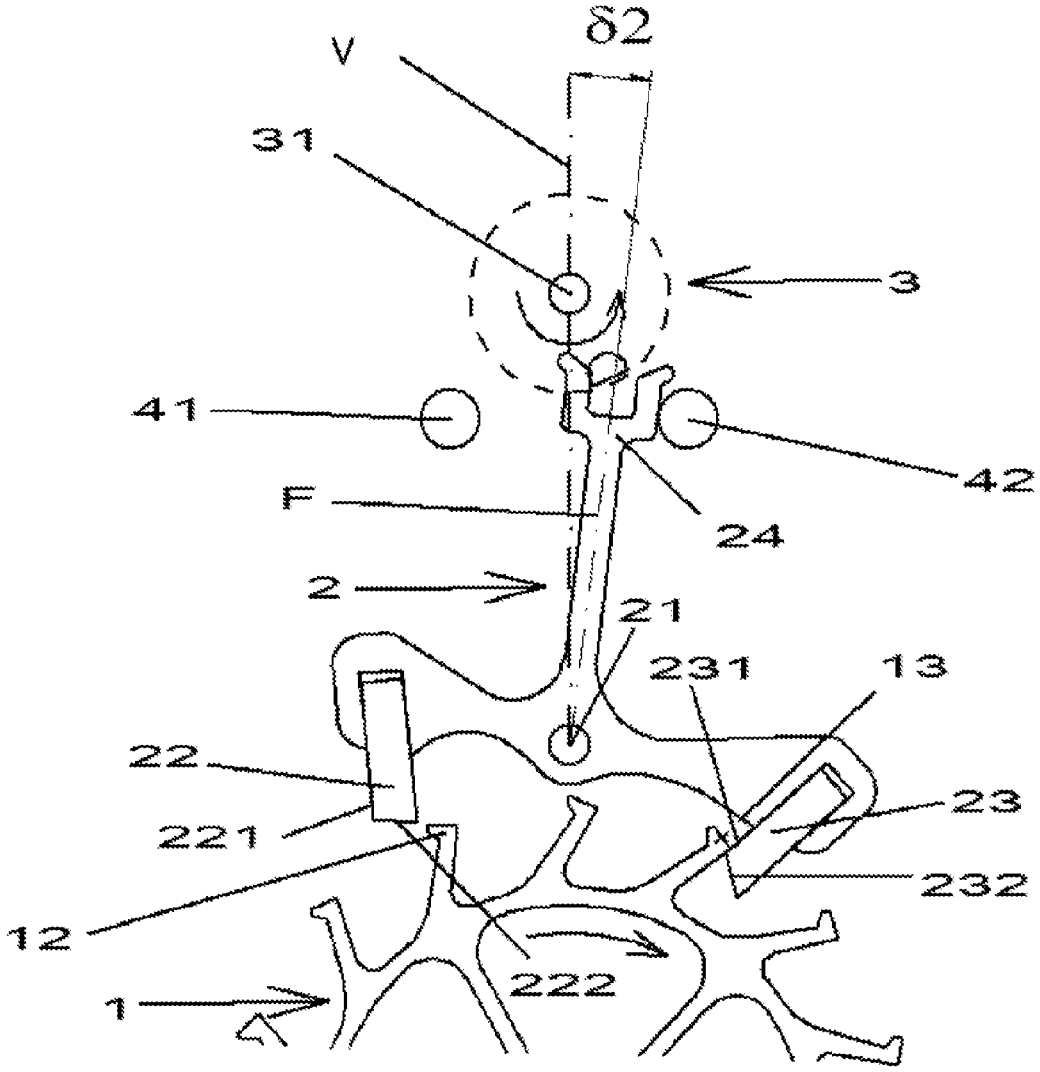
Fig. 3 (Prior Art)
FIG. 3 represents the output locking position of a typical Swiss lever escapement.

FIG. 2 represents the end of contact between the input pallet stone and the tooth 12 of the escapement wheel. In this position the straight line F of the fork 24 forms an angle 61 with respect to the reference axis V passing through the axes 21 and 31. When the tooth 12 leaves the impulse plane 222 of the input pallet stone, the tooth 13 of the escapement wheel will meet the output pallet stone 23. In this case, several possibilities arise:

If all elements of the escapement: the escapement wheel 1, the input and output pallet stones 22 and 23, the lever, the pins 41 and 42, the distance between the rotation axes, have the ideal dimensions corresponding to the nominal values, the tooth comes in contact with the locking-face 231 and pushes the fork of the lever towards the pin 42 in order to stabilize in the output locking position represented by FIG. 3. Generally the ideal position of the end of the tooth with respect to the end of the locking-face of the pallet stones is of the order of 0.05 mm.

In the output locking position, the straight line F of the fork 24 forms an angle δ2 with respect to the reference axis V passing through the axes 21 and 31. It is noted that in a typical lever escapement, the input end of contact angle δ1 is smaller than the output locking angle δ2.

Figure 4:
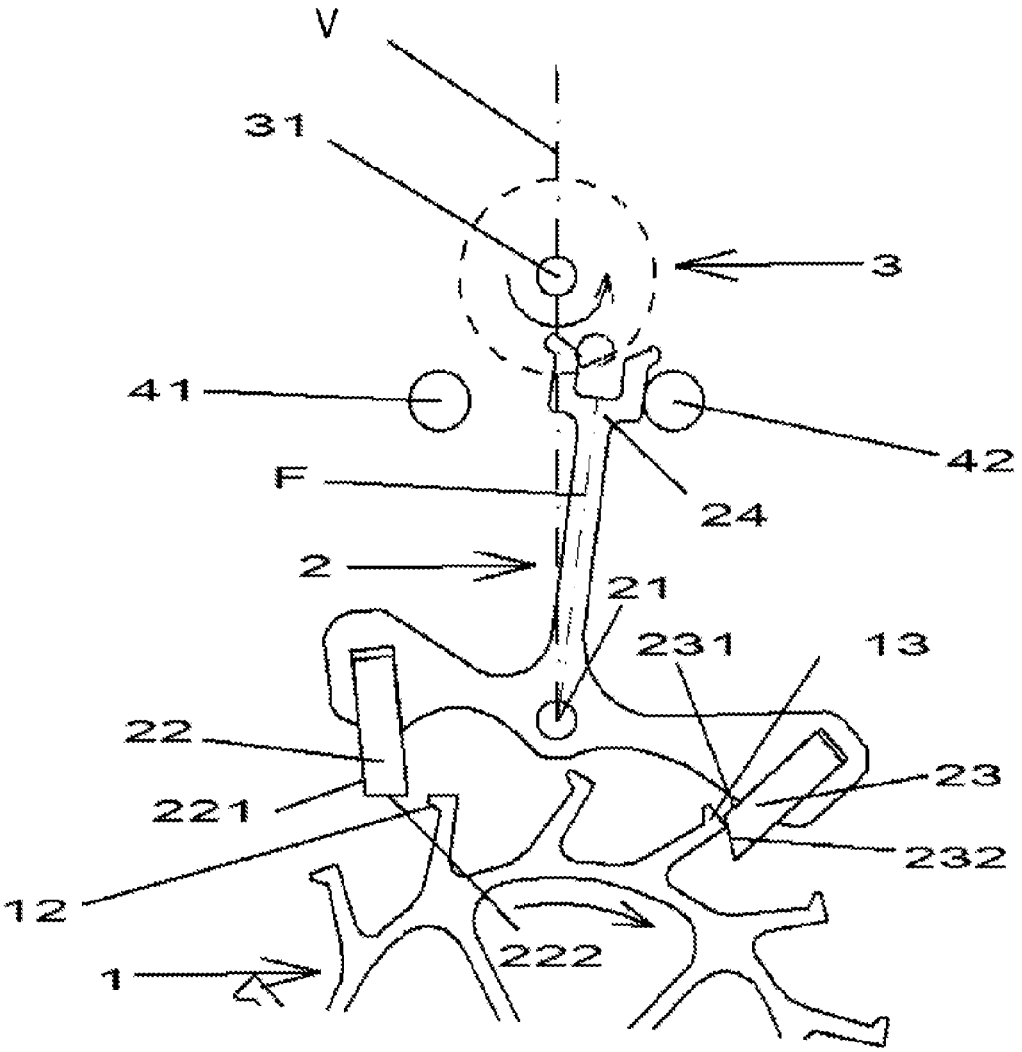
Fig. 4 (Prior Art)
FIG. 4 represents a first case of error of positioning a typical Swiss lever escapement.
Figure 5:
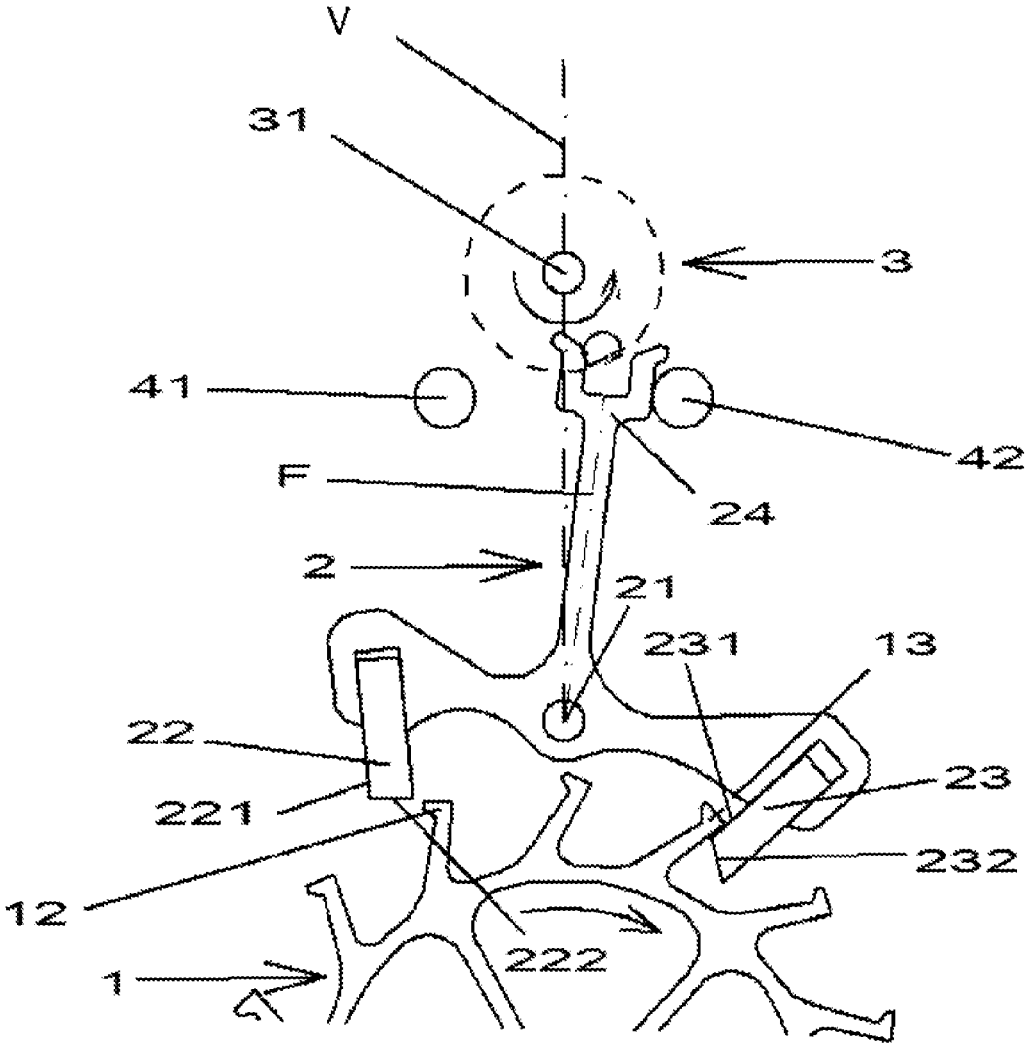
Fig. 5 (Prior Art)
FIG. 5 represents a second case of error of positioning a typical Swiss lever escapement.

If one or several elements of the escapement does/do not have the ideal value, the tooth 13 can rest either on the impulse plane 232 instead of the locking-face 231 (FIG. 4), or on the locking-face 231 at a great distance with respect to the end of this plane (FIG. 5). In these 2 cases the performance of the escapement decreases significantly.

Figure 6:
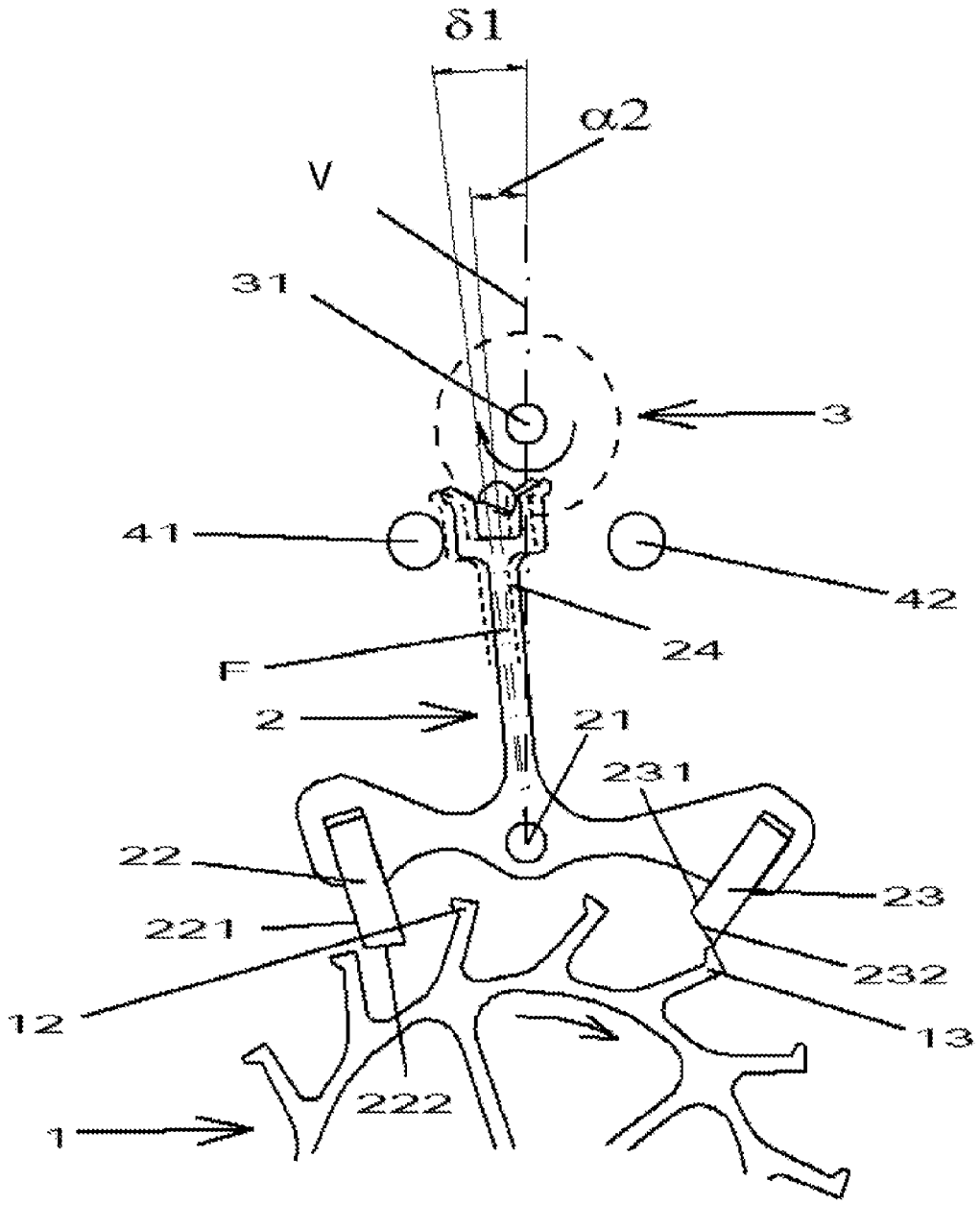
Fig. 6 (Prior Art)
FIG. 6 represents the end of contact between the output pallet stone and the tooth of the escapement wheel of a typical Swiss lever escapement.

By analogy, FIG. 6 represents the end of contact between the output pallet stone 23 and the tooth 13 of the escapement wheel. In this position, δ2 represents the angle between the reference axis V and the straight line F of the fork. The output end of contact angle δ2 is also less than the input locking angle δ1 corresponding to the input locking position of the lever.

It is easily understood that when the end of contact angles δ1 and δ2 are lower than the locking-angles δ2, δ1, and taking into consideration the manufacturing tolerances, the final adjustment of the length of the pallet stones is inevitable to obtain a good operating of the escapement.

To remedy to this drawback, the invention proposes a type of escapement such as described below.

Figure 7:
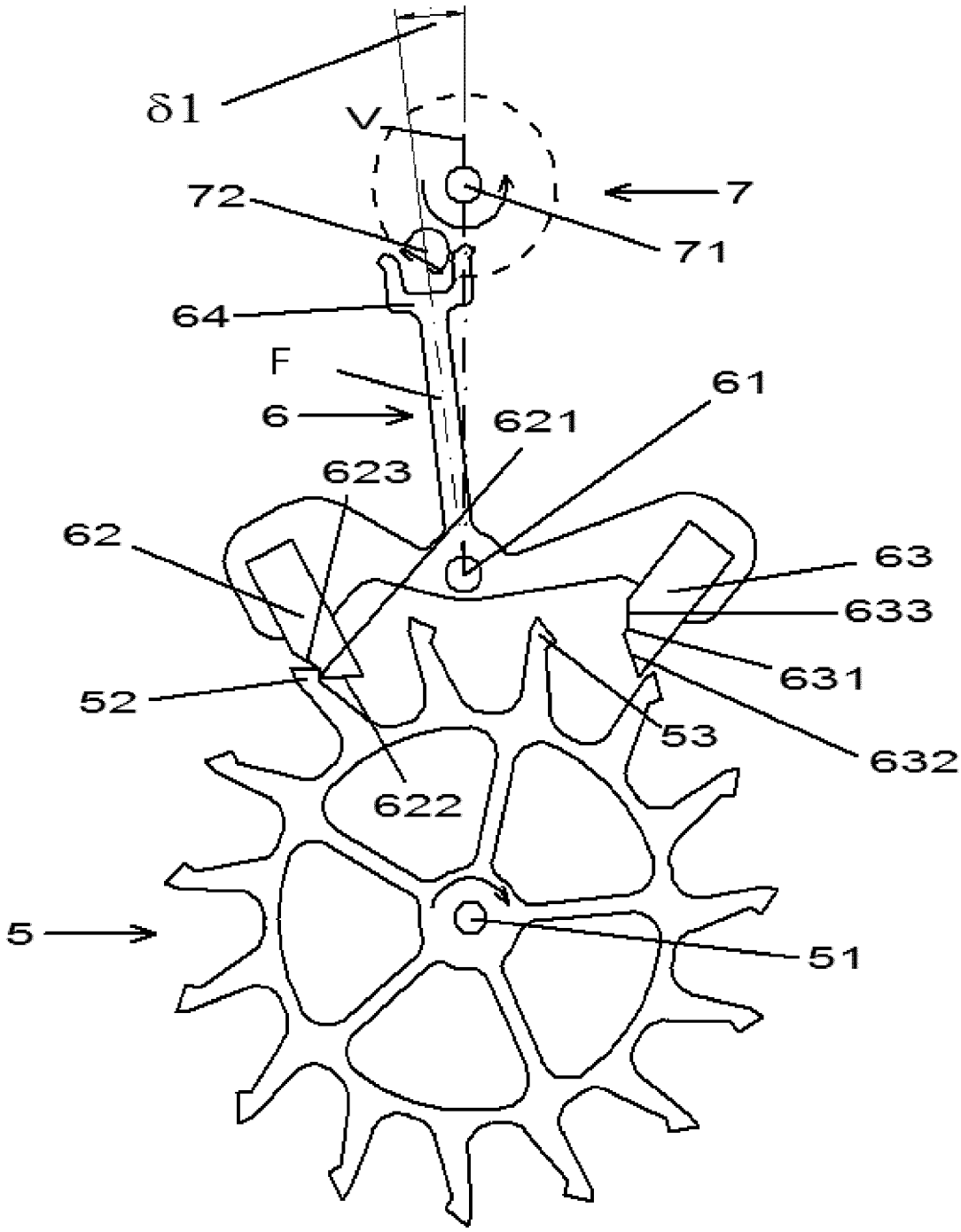
FIG. 7 represents a first embodiment example of the escapement according to the invention.

FIG. 7 represents a first embodiment example of the escapement according to the invention. This escapement has:

- an escapement wheel 5 rotating around the rotation axis 51 in the clockwise direction.
- a lever 6 rotating around the axis 61 and comprising an input pallet stone 62 and an output pallet stone 63 and a fork
- a balance wheel plate 7 rotating around the axis 71 and carrying an impulse-pin 72.

The input pallet stone comprises a locking-face 621, an impulse plane 622, a driving plane 623 while the output pallet stone has a locking-face 631, an impulse plane 632, a driving plane 633.

The straight line which connects the axes 61 and 71 serves as a reference axis V for measuring the angle of the straight line F of the lever 6.

In FIG. 7, the escapement is found in the input locking position of the lever, the axis of the fork A forms an angle δ1 with respect to V. In this position, the tooth 52 of the escapement wheel bears on the intersection of the locking-face and driving planes 621 and 623 of the input pallet stone 62.

This position is a locking or a stable balanced position as the locking 621 and driving 623 surfaces are oriented with respect to the rotation axis 61 so that the tooth 52 pushes the lever in the counterclockwise direction if it bears on the surface 621 and in the clockwise direction if it bears on the surface 623.

By analogy, the intersection between the locking 631 and driving planes 633 is also a locking or stable balanced position for the tooth 53 because the locking 631 and driving 633 surfaces are oriented with respect to the rotation axis 61 so that the tooth 53 pushes the lever in the clockwise direction if it is found on the surface 631 and in the counterclockwise direction if it is found on the surface 633.

In general, the driving and the locking surfaces are arranged so that, when the tooth of the escapement wheel bears on a driving surface, it moves the lever to reduce the angle between the axis A of the fork and the reference axis V, whereas if it bears on a locking surface, it displaces the lever to increase this angle.

Figure 8:
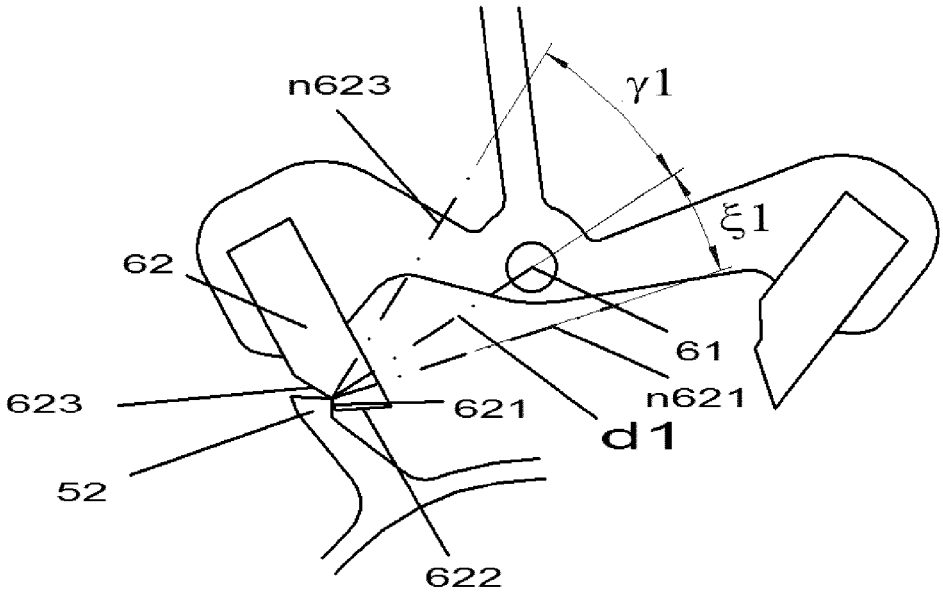
FIG. 8 illustrates the detail of the driving plane and input locking-face of the first embodiment example of the escapement according to the invention.

FIG. 8 illustrates the detail of the driving 623 and locking 621 planes.

In this figure n621 is the normal to the plane 621 and n623 is the normal to the plane 623 while d1 represents the straight line connecting the intersection of the planes 621, 623 and the axis 61.

The angle ξ1 between n621 and d1 represents the angle of draw of the input pallet stone and the angle γ1 between n623 and d1 represents the driving angle of the input pallet stone.

Figure 9:
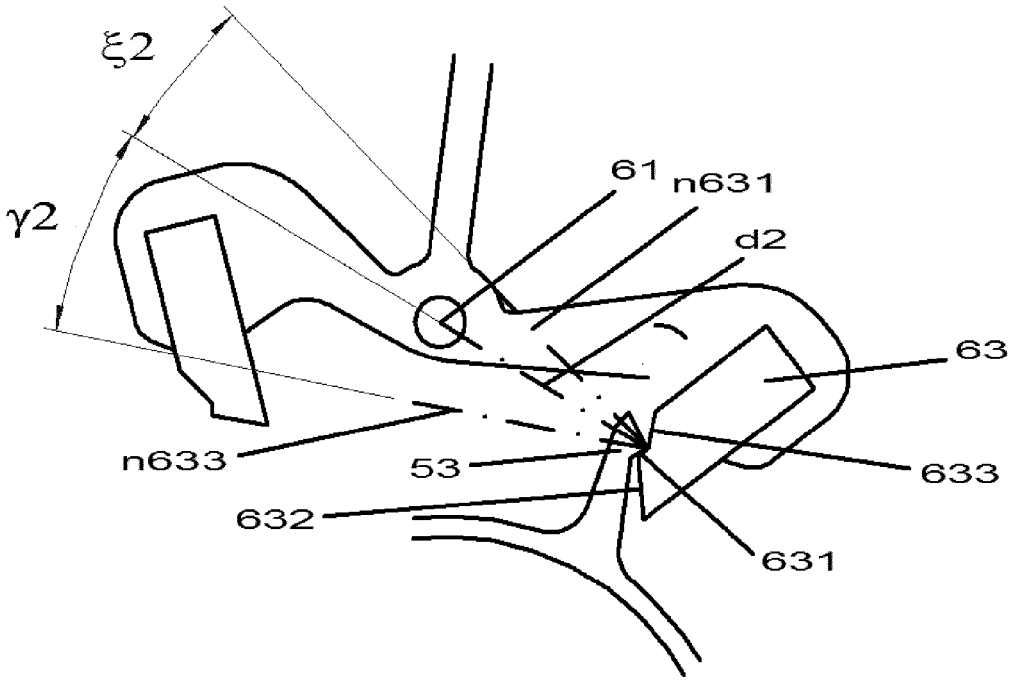
FIG. 9 illustrates the detail of the driving plane and output locking-face of the first embodiment example of the escapement according to the invention.

By analogy, FIG. 9 illustrates the detail of the driving plane 633 and the locking-face 631.

The angle ξ2 between n631 and d2 represents the angle of draw of the output pallet stone and the angle γ2 between n633 and d2 represents the driving angle of the output pallet stone.

To obtain a good stabilization of the tooth at locking point, according to the frequency of the spiral balance wheel and the number of teeth of the escapement wheel, the value of ξ1, ξ2 must range between 5 and 20 degrees and the value of γ1, γ2 between 12 and 38 degrees.

When the impulse-pin of the plate 72 of FIG. 7 comes into contact with the fork 64, it frees the lever from its input locking position. The tooth 52 of the escapement wheel slides on the impulse plane 622 of the input pallet stone.

Figure 10:
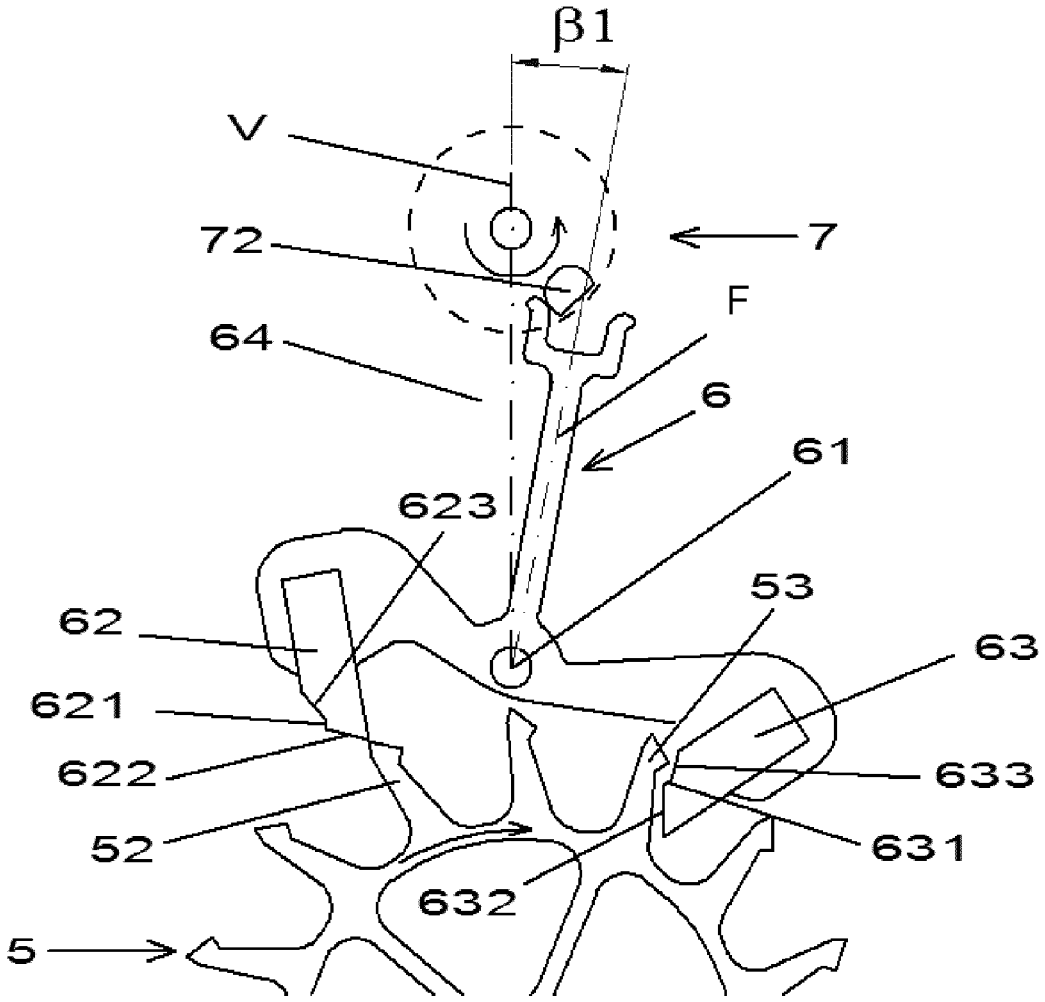
FIG. 10 represents the end of contact between the input pallet stone and the tooth of the escapement wheel of the first embodiment example of the escapement according to the invention.
Figure 11:
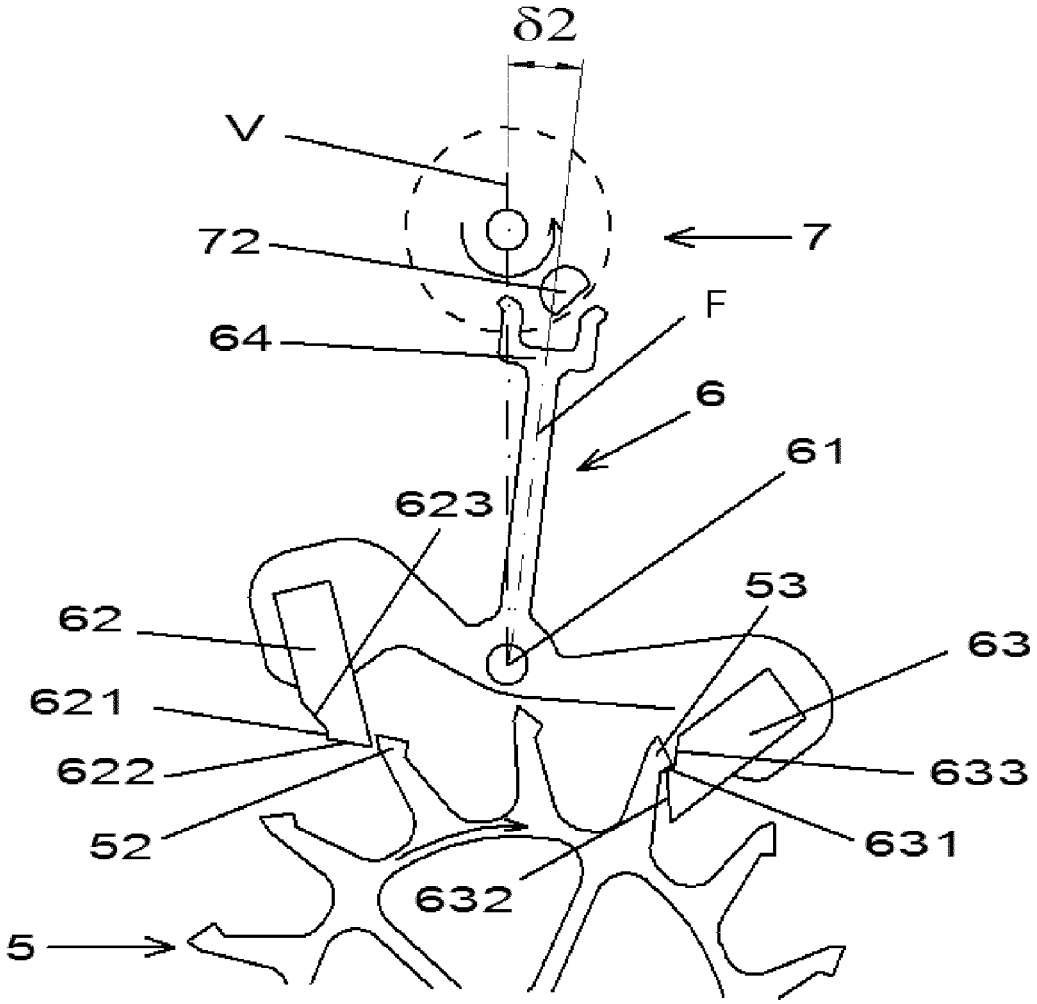
FIG. 11 represents the output locking position of the first embodiment example of the escapement according to the invention.

FIG. 10 represents the end of contact between the input pallet stone and the tooth 52 of the escapement wheel, in this position the angle between A and V is equal to β1. This angle is chosen so that, considering the manufacturing tolerances, the tooth 53 always meets the driving plane 633. Under these conditions, the tooth 53, bearing on the surface 633, pushes the lever in the counterclockwise direction to bring it to the output stable position represented by FIG. 11.

It is noted that in the case of the escapement according to the invention, the angle δ2 is greater than the angle δ2 contrary to the case of a typical escapement.

Figure 12:
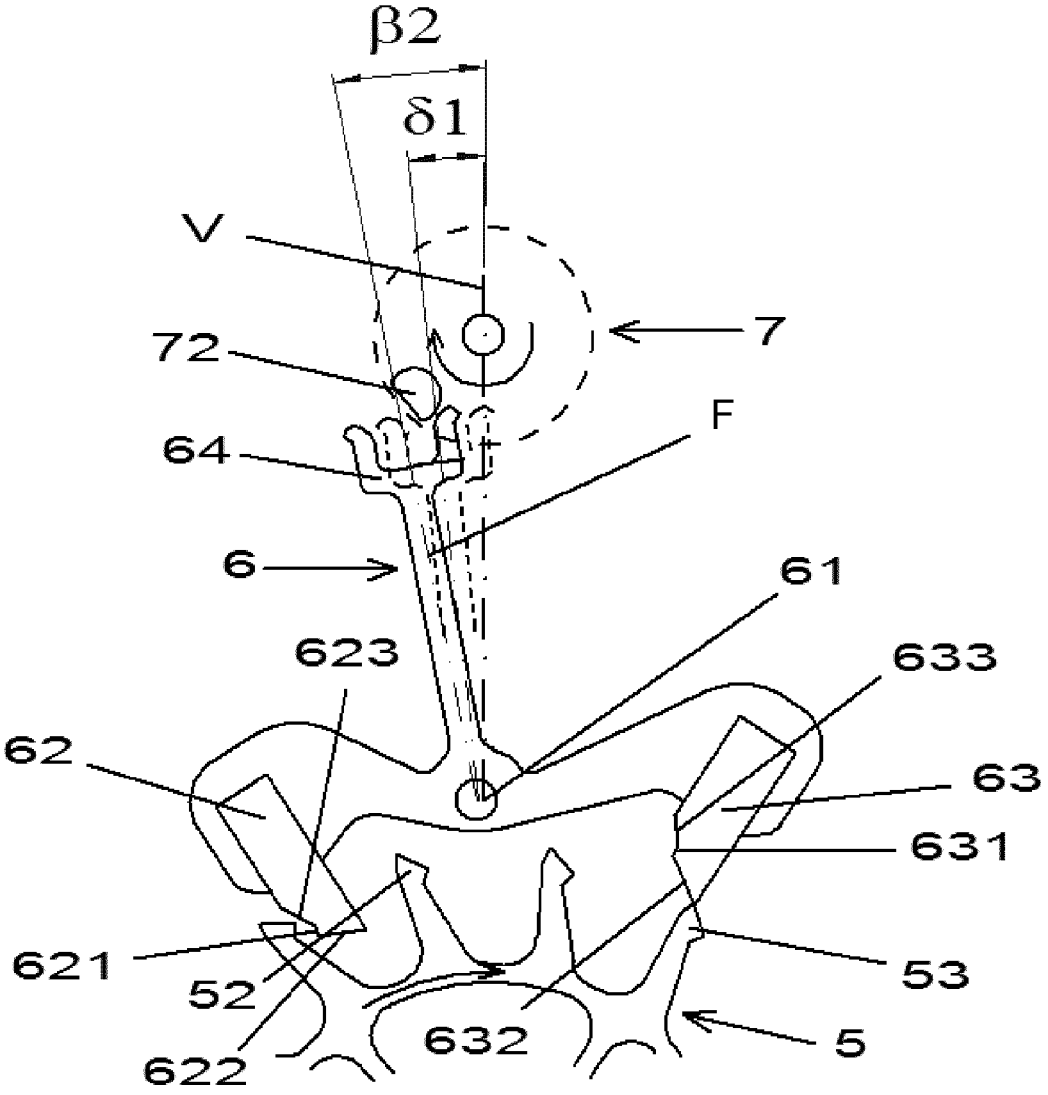
FIG. 12 represents the end of contact between the output pallet stone and the tooth of the escapement wheel of the first embodiment example of the escapement according to the invention.

By analogy, FIG. 12 represents the end of contact between the output pallet stone and the tooth 53 of the escapement wheel. In this position, β2 represents the angle between the reference axis V and the axis A of the fork. This angle β2 is also higher than the angle δ1 of the input locking position.

Practical tests have shown that for the teeth of the escapement wheel to always meet the driving planes 623 and 633 after the contact with the impulse planes 632 and 622, in the entire range of the usual manufacturing tolerances, it is essential that the ratio β1/d2 of the input end of contact angle β1 and the angle δ2 is higher than 1.045. Similarly, the ratio β2/δ1 of the output end of contact angle β2 and δ1 must be higher than 1.045.

This ratio may vary depending on several parameters such as the angles δ1, δ2, the number of teeth of the escapement wheel, the width of the head of the teeth of the escapement wheel, pallet stone width etc.

Figure 13:
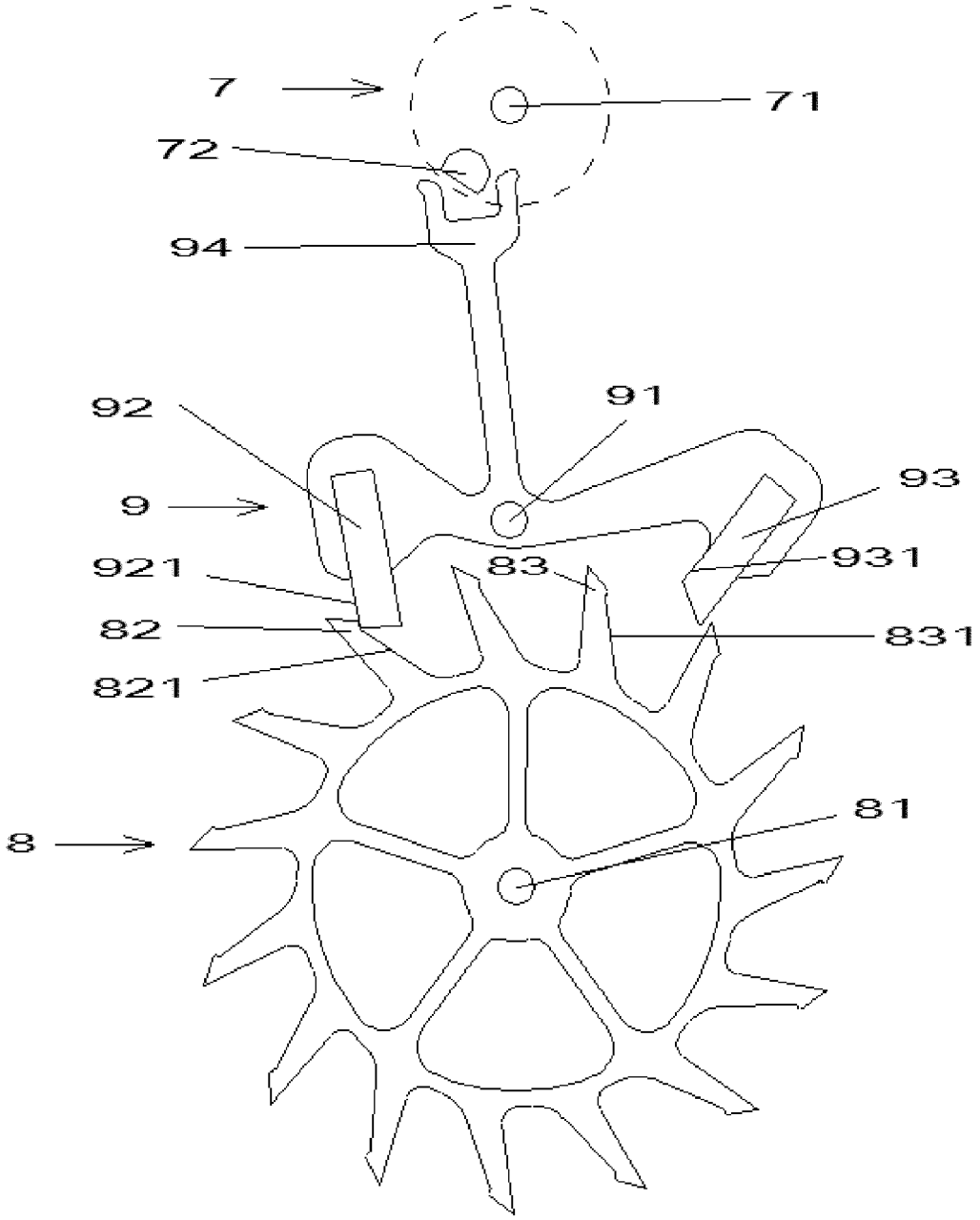
FIG. 13 represents a second embodiment example of the escapement according to the invention.

FIG. 13 represents a second embodiment example of the escapement according to the invention. This escapement has:

- an escapement wheel 8 rotating around the rotation axis 81 in the clockwise direction.
- a lever 9 rotating around the axis 91 and comprising an input pallet stone 92 and an output pallet stone 93 and a fork
- a plate of a balance wheel 7 rotating around the axis 71 and carrying an impulse-pin 72.

The operating principle of this escapement is practically identical to that of FIG. 7 except for the driving planes.

In the embodiment example of FIG. 7, the driving planes 623 and 633 are placed on the pallet stones of the lever whereas in the present case these driving planes are placed at the teeth of the escapement wheel.

In FIG. 13, the driving planes 821, 831 of the teeth 82 and 83 are represented.

Figure 14:
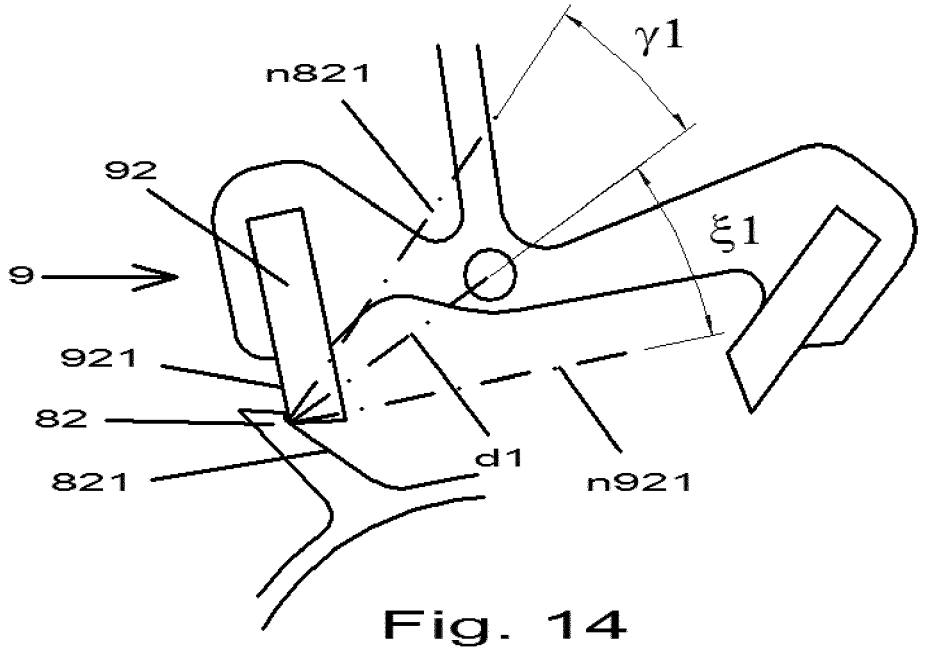
FIG. 14 represents the detail of the driving plane and locking-face in the input locking position of the example of FIG. 13.

FIG. 14 represents the detail of the driving plane 821 and the locking-face 921.

The angle ξ1 between n921 and d1 represents the angle of draw of the input pallet stone and the angle γ1 between n821 and d1 represents the input driving angle of the tooth of the escapement wheel.

It is observed that the 2 planes have the same functions as those in the case of the first embodiment example.

Figure 15:
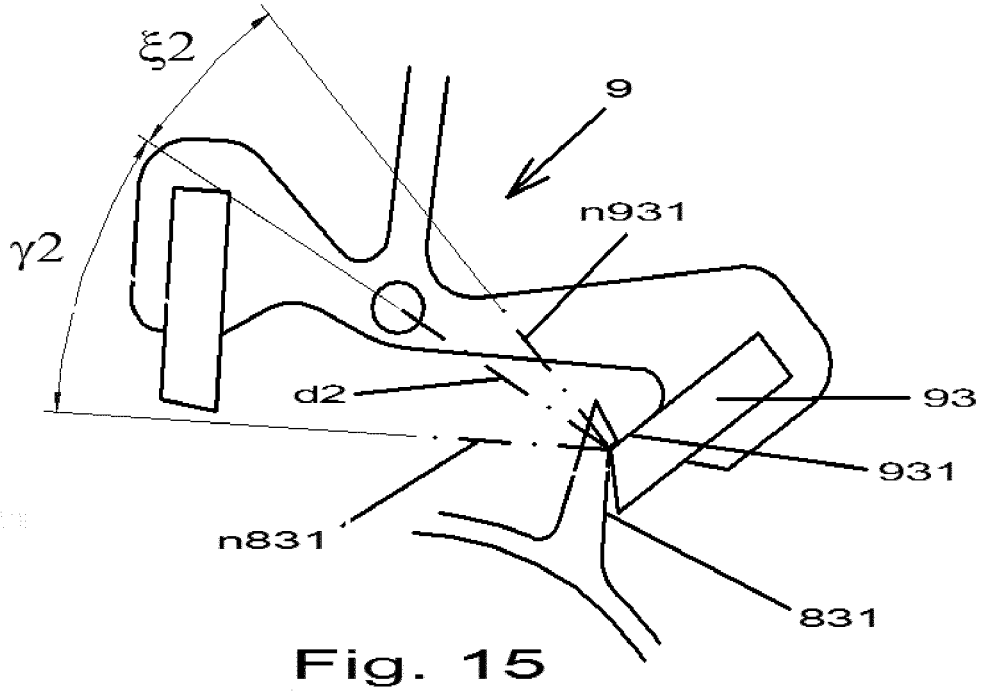
FIG. 15 represents the detail of the driving plane and locking-face in the output locking position of the example in FIG. 13.

By analogy, FIG. 15 illustrates the detail of the driving plane 831 and the locking-face 931.

The angle ξ2 between n931 and d2 represents the angle of draw of the output pallet stone and the angle γ2 between n831 and d2 represents the output driving angle of the tooth of the escapement wheel.

Figure 16:
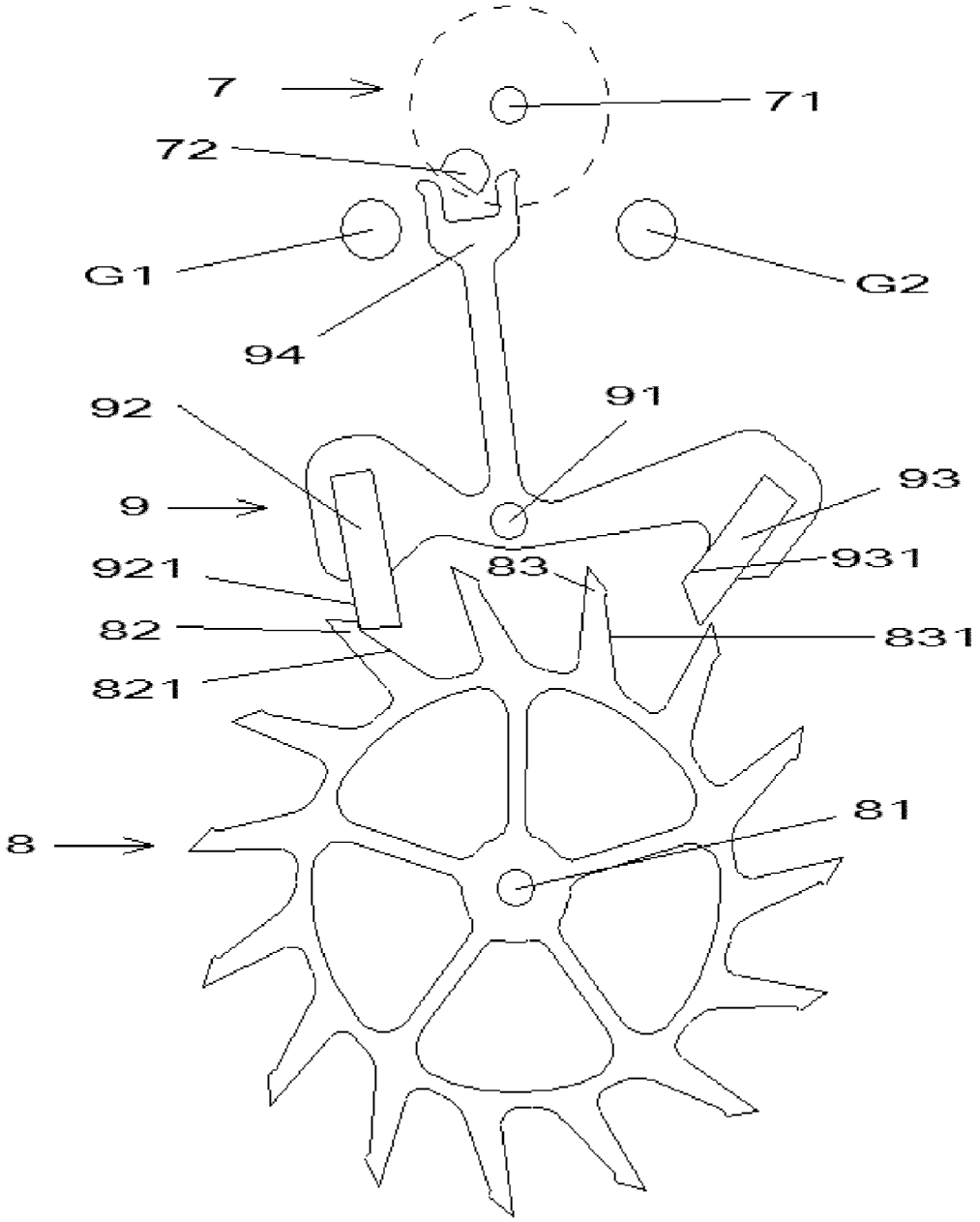
FIG. 16 represents a variant of the second embodiment example of the escapement according to the invention.

FIG. 16 represents a variant of the second example of the escapement according to the invention. In this embodiment example the escapement has, in addition to the elements of the example 13, two limiting pins G1, G2. These pins do not participate in the normal operating of the escapement but their purpose is to limit the amplitude of the lever in the case of very big shocks. It is obvious that these pins must be placed outside the trajectories of the lever in the case of normal operating, as unlike a typical escapement, they do not serve as mechanical stops during normal operating.

The invention claimed is:

1. A lever escapement comprising:

an escapement wheel;

a balance wheel;

a balance wheel axis around which the balance wheel can pivot;

a lever with an input pallet stone and an output pallet stone;

a lever axis around which the lever can pivot in an angular oscillation movement; and a reference axis (V) passing through the balance wheel axis and the lever axis;

wherein the escapement wheel, the input pallet stone, and the output pallet stone are arranged so that an input end of a contact angle β1 of the lever with the reference axis (V) is higher than an output locking-angle δ2 of the lever with the reference axis (V);

and/or so that an output end of contact angle β2 of the lever with the reference axis (V) is higher than an input locking-angle δ1 of the lever with the reference axis (V).

2. The escapement according to claim 1 wherein the ratio β1/δ2 of the input end of contact angle β1 and the output locking-angle δ2 is higher than 1.045 and/or the ratio β2/δ1 of the output end of contact angle β2 and the input locking-angle δ1 is higher than 1.045.

3. The escapement according to claim 1, further comprising at least one driving plane, being either on one of the pallet stones of the lever or on the escapement wheel and being oriented so that contact between the lever and the escapement wheel via the at least one driving plane creates a torque that tends to reduce an angle between the lever and the reference axis (V) connecting the axis of the lever and the axis of the balance wheel.

4. The escapement according to claim 3, wherein driving angles γ1 and/or γ2 of the pallet stones or of the teeth of the escapement wheel range between 12 and 38 degrees.

5. The escapement according to claim 1, further comprising limiting pins (G1, G2) to limit a movement of the lever in the event of shock.

6. A timepiece fitted with an escapement according to claim 1.

* * * * *